US008444777B2

(12) United States Patent
Hata et al.

(10) Patent No.: US 8,444,777 B2
(45) Date of Patent: May 21, 2013

(54) HIGH-STRENGTH AND HIGH-DUCTILITY AL ALLOY AND PROCESS FOR PRODUCTION OF THE SAME

(75) Inventors: Hideo Hata, Kobe (JP); Katsura Kajihara, Kobe (JP); Shigenobu Namba, Kobe (JP); Hiroyuki Takeda, Kobe (JP); Mamoru Nagao, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 307 days.

(21) Appl. No.: 12/529,030

(22) PCT Filed: Feb. 20, 2008

(86) PCT No.: PCT/JP2008/052904

§ 371 (c)(1),
(2), (4) Date: Aug. 28, 2009

(87) PCT Pub. No.: WO2008/105303

PCT Pub. Date: Sep. 4, 2008

(65) Prior Publication Data

US 2010/0101748 A1 Apr. 29, 2010

(30) Foreign Application Priority Data

Feb. 28, 2007 (JP) ..... 2007-049891
Jul. 31, 2007 (JP) ..... 2007-199598

(51) Int. Cl.
*C22C 21/10* (2006.01)
*B22D 23/00* (2006.01)

(52) U.S. Cl.
USPC ..... 148/417; 420/532; 420/539; 164/46

(58) Field of Classification Search
USPC ..... 148/417; 420/532, 539; 164/46
See application file for complete search history.

(56) References Cited

U.S. PATENT DOCUMENTS

| | | | |
|---|---|---|---|
| 4,575,450 | A | 3/1986 | Meunier |
| 4,995,920 | A | 2/1991 | Faure et al. |
| 2009/0041616 | A1 | 2/2009 | Takagi et al. |

FOREIGN PATENT DOCUMENTS

| | | | | |
|---|---|---|---|---|
| CN | 1530455 | A | | 9/2004 |
| CN | 1834277 | A | | 9/2006 |
| JP | 63 18034 | | | 1/1988 |
| JP | 2 258935 | | | 10/1990 |
| JP | 5 179384 | | | 7/1993 |
| JP | 7 316601 | | | 12/1995 |
| JP | 07316601 | A | * | 12/1995 |
| JP | 2006 104561 | | | 4/2006 |
| JP | 2006 104562 | | | 4/2006 |
| JP | 2006 104563 | | | 4/2006 |
| JP | 2006 104564 | | | 4/2006 |
| JP | 2007 39748 | | | 2/2007 |
| WO | WO 2009/016890 | A1 | | 2/2009 |

OTHER PUBLICATIONS

Baiqing, Xiong. "Research on Ultra-high Strength Al-11Zn-2.9Mg-1.7Cu Alloy Prepared by Spray Forming Process", Materials Science Forum, vols. 475-479 (2005), pp. 2785-2788.*

Xiong Baiqing, et al., "Research on Ultra-high Strength Al-11Zn-2.9Mg-1.7Cu Alloy Prepared by Spray Forming Process", Materials Science Forum, vols. 475-479, 2005, pp. 2785-2788.

P. Lengsfeld, et al., "Microstructure and Mechanical Behavior of Spray Deposited Zn Modified 7XXX Series Al Alloys", International Journal of Rapid Solidification, vol. 8, 1995, pp. 237-265.

* cited by examiner

*Primary Examiner* — Roy King
*Assistant Examiner* — Janelle Morillo
(74) *Attorney, Agent, or Firm* — Oblon, Spivak, McClelland, Maier & Neustadt, L.L.P.

(57) ABSTRACT

An object of the present invention is to provide an Al—Zn—Mg—Cu 7000-series Al alloy having high ductility as well as having high strength. For attaining this purpose, an Al alloy having a structure in which an inclusion is not included is produced by reducing an amount of oxygen contained in an Al alloy that is obtained by solidifying a preform resulting from rapid solidification by preferably spray forming a molten metal of an Al—Zn—Mg—Cu 7000-series Al alloy with an inert gas. This Al alloy has, as mechanical properties at an ordinary temperature, a tensile strength of 600 MPa or more, and an elongation of 15% or more when the tensile strength is from 600 MPa or more and less than 800 MPa or an elongation of 10% or more when the tensile strength is 800 MPa or more, and is excellent in cold workability such as rollability.

11 Claims, No Drawings

HIGH-STRENGTH AND HIGH-DUCTILITY AL ALLOY AND PROCESS FOR PRODUCTION OF THE SAME

TECHNICAL FIELD

The present invention relates to a high-strength and high-ductility Al alloy which is an Al—Zn—Mg—Cu 7000-series Al alloy obtained by a rapid solidification process, and a process for production of the same.

The "Al alloy obtained by a rapid solidification process" as used in the present invention means an Al alloy obtained by solidifying a powder or preform resulting from rapid solidification by gas atomization of a molten metal of an Al alloy. The solidified Al alloy means an Al alloy produced by densifying the rapidly solidified powder or preform by hot plastic working such as extrusion, forging and rolling, and also means an Al alloy material having various shapes, which is produced by applying, after the densification, a heat treatment such as solution treatment or aging treatment, and indicates an Al alloy material that is subjected to a forming work such as cold forming into a desired shape according to the usage by taking advantage of its high ductility, and used as desired members or components by taking advantage of its high strength.

BACKGROUND ART

Recently, in automobile parts, parts for electronics, precision machinery components and the like, which are increasingly required to reduce the weight, a high-strength light-weight Al alloy material is being widely used.

The mechanical properties at ordinary temperature of the Al alloy are remarkably improving in recent years but are still insufficient compared with a high-strength steel, and use of this alloy is limited. For example, even a so-called A7000-series Al alloy widely used as a high-strength Al alloy is not satisfied with its strength and is limited in the range of use.

As for conventional alloys by melting and casting, there is a limit to the significant improvement of mechanical properties such as strength. Therefore, a process of obtaining an A7000-series Al alloy as a rapidly solidified powder by an atomization process has been heretofore proposed with an attempt to more increase the strength. According to the rapid solidification process, a content of the alloy element can be more increased than that in the Al alloy by conventional melting and casting. Consequently, an Al alloy with excellent strength can be obtained by rapidly solidifying an Al alloy containing a large amount of such an alloy element into a powder and subjecting this to solidification and forming.

For example, in Patent Document 1, a component composition of an A7000-series Al alloy is prepared by blending a specific amount of Ag, and a rapidly solidified alloy powder of this component composition obtained by an air atomization process is formed into a solidified shaped body by powder metallurgy process by extrusion. Incidentally, it is indicated that when this shaped body is subjected to a homogenization treatment and an aging hardening treatment, the tensile strength of the shaped body material after T6 heat treatment can be increased up to about 900 MPa. In Patent Document 1, as regards a more specific composition of the A7000-series Al alloy, a rapidly solidified powder of the A7000-series Al alloy containing from 5 to 11% of Zn, from 2 to 4.5% of Mg, from 0.5 to 2% of Cu and from 0.01 to 0.5% of Ag, with a remainder consisting substantially of Al is disclosed.

Patent Document 1: JP-A-7-316601

DISCLOSURE OF THE INVENTION

Problems that the Invention is to Solve

Patent Document 1 discloses an A7000-series Al alloy having high strength but is silent on the elongation of this high-strength Al alloy. Even a rapidly solidified powder of the A7000-series Al alloy in Patent Document 1 is still unable to avoid a problem that as the strength becomes higher, the elongation is more greatly reduced. For example, according to the data disclosed in literatures and the like, in respect of an Al—Zn—Mg—Cu 7000-series Al alloy, when the tensile strength of a shaped material of a rapidly solidified powder of an A7090 Al alloy is 625 MPa, the elongation is as low as about 6%. Even in the case of an extruded material of an A7075 Al alloy that is a normal casting material, the total elongation is about 11% when the tensile strength is 570 MPa.

With such a low elongation, the formability at the cold work into a desired member or component shape is extremely low and the cold working is difficult. For example, the cold forming work having a high reduction ratio, such as rolling, is particularly liable to cause cracking. Because of such a limitation of the cold forming work, the usage of the high-strength 7000-series Al alloy is greatly limited in fact.

The present invention has been made taking these problems into consideration and an object of the present invention is to provide an Al—Zn—Mg—Cu 7000-series Al alloy having not only a high strength of 600 MPa or more in terms of tensile strength but also high elongation for the high strength and being excellent in cold forming workability.

Means for Solving the Problems

For achieving this object, a gist of the high-strength and high-ductility Al alloy of the present invention resides in an Al alloy obtained by a rapid solidification process, comprising from 5 to 12 mass % of Zn, from 2 to 4 mass % of Mg and from 1 to 2 mass % of Cu, with a remainder being Al and an unavoidable impurity, wherein an amount of oxygen contained in the Al alloy as measured by an extraction residue method using hot phenol is 0.1 mass % or less in terms of oxygen in a solid residue which is separated and extracted from the Al alloy and has a size of 0.1 μm or more, and the Al alloy has, as mechanical properties at an ordinary temperature, a tensile strength of 600 MPa or more, and an elongation of 15% or more when the tensile strength is from 600 MPa or more and less than 800 MPa or an elongation of 10% or more when the tensile strength is 800 MPa or more.

For obtaining high strength, the high-strength and high-ductility Al alloy of the present invention may further contain from 0.01 to 0.1 mass % of Ag and also, may further contain from 0.1 to 0.5 mass % in total of one kind or two or more kinds selected from Si, Fe, Mn, Cr, Co, Ni, Zr, Ti and V.

For achieving the object above, a gist of the process for producing a high-strength and high-ductility Al alloy of the present invention resides in subjecting a molten metal of an Al alloy containing from 5 to 12 mass % of Zn, from 2 to 4 mass % of Mg and from 1 to 2 mass % of Cu and further selectively containing from 0.01 to 0.1 mass % of Ag or from 0.1 to 0.5 mass % in total of one kind or two or more kinds selected from Si, Fe, Mn, Cr, Co, Ni, Zr, Ti and V, with a remainder being Al and an unavoidable impurity, to spray forming with an inert gas having a G/M ratio of 2 to 15 $Nm^3/kg$; placing and vacuum-encapsulating a preform obtained thereby in a metal vessel; solidifying the preform by hot extrusion; and then applying a heat treatment thereto to obtain an Al alloy, wherein an amount of oxygen contained in the Al alloy as measured by an extraction residue method using hot phenol is set to 0.1 mass % or less in terms of oxygen in a solid residue which is separated and extracted from the Al alloy and has a size of 0.1 μm or more, wherein the Al alloy has, as mechanical properties at ordinary temperature, a tensile strength of 600 MPa or more, and an elongation of 15% or more when the tensile strength is from 600 MPa or more and less than 800 MPa or an elongation of 10% or more when the tensile strength is 800 MPa or more.

Advantage of the Invention

In the present invention, the oxygen in an Al—Zn—Mg—Cu 7000-series Al alloy obtained by solidifying a powder or preform resulting from rapid solidification by gas atomization is reduced as specified above. Due to this reduction, the amount of an oxide inclusion in the Al alloy microstructure is reduced and despite high strength of 600 MPa or more, the alloy can have a high elongation.

Substantially all oxygen contained in the objective Al alloy forms an oxide inclusion in the microstructure. The oxide inclusion becomes an origin of fracture, decreases the elongation and conspicuously impairs the formability at cold working.

In the present invention, the amount of oxygen contained in the objective Al alloy is reduced as specified above by an extraction residue method using hot phenol and the amount of an oxygen inclusion in the microstructure of the objective Al alloy is remarkably reduced, so that despite a high strength of 600 MPa or more, the alloy can have a drastically high elongation as specified above. More specifically, according to the present invention, an Al—Zn—Mg—Cu 7000-series Al alloy obtained by solidifying a powder or reform resulting from rapid solidification by gas atomization can have an elongation of 15% or more when the tensile strength is 600 MPa or more (and less than 800 MPa) or an elongation of 10% or more when the tensile strength is 800 MPa or more.

Incidentally, when the amount of oxygen in the objective Al alloy is reduced as specified in the present invention, an oxide inclusion in the microstructure can be reduced to such an extent that the inclusion cannot be recognized even by the observation of the microstructure with SEM or TEM. This fact confirms the above-described effect that the objective Al alloy has a drastically high elongation, despite a high strength of 600 MPa or more.

BEST MODE FOR CARRYING OUT THE INVENTION (Composition of Al Alloy)

The chemical component composition (unit: mass %) of the Al alloy of the present invention is described below, including the reasons for limitation of each element. Here, the % indicative of the content of each element all means mass %.

The chemical component composition of the Al alloy of the present invention is determined so as to ensure mechanical properties intended in the present invention of an Al—Zn—Mg—Cu 7000-series Al alloy obtained by the later-described rapid solidification process. For this purpose, the chemical component composition of the Al alloy of the present invention is specified to contain from 5 to 12 mass % of Zn, from 2 to 4 mass % of Mg and from 1 to 2 mass % of Cu, with a remainder being Al and an unavoidable impurity. To this composition, each of from 0.1 to 0.01% of Ag and from 0.1 to 0.5% in total of one kind or two or more kinds selected from Si, Fe, Mn, Cr, Co, Ni, Zr, Ti and V may be incorporated as a selective additive element.

(Zn, Mg)

Zn and Mg which are essential alloy elements form a fine dispersed phase such as $MgZn_2$ and $Mg_{32}AlZn_{49}$ called a GP zone or a precipitated intermediate phase after T6 treatment and thereby enhance the strength. If the contents of Zn and Mg are too small, for example, if the content of Zn is less than 5% or the content of Mg is less than 2%, the fine dispersed phase is lacking and the strength decreases.

On the other hand, if the contents of Zn and Mg are excessively large, for example, if the content of Zn exceeds 12% or the content of Mg exceeds 4%, even if a molten metal is rapidly solidified, these elements cannot dissolve in Al but form a coarse dispersoid to cause reduction in strength of the Al alloy. Also, the cold workability seriously deteriorates. Furthermore, if the content of Zn is excessively large, although it may vary depending on the solution treatment temperature, a liquid phase is readily produced during the solution treatment and therefore, for example, the temperature must be decreased to sacrifice the solution effect, making the solution treatment itself difficult. For these reasons, the contents thereof are specified to the range from 5 to 12% for Zn and from 2 to 4% for Mg.

(Cu)

Cu which is an essential alloy element enhances the strength by solid-solution hardening. If the content of Cu is too small, that is, if the content of Cu is less than 1%, the amount of Cu dissolved is decreased and the strength is reduced, whereas if the content of Cu is excessively large to exceed 2%, the precipitate is coarsened and this causes serious deterioration of the corrosion resistance such as resistance to stress corrosion cracking. For these reasons, the content of Cu is specified to the range from 1 to 2%.

(Ag)

Ag which is a selective additive element has an effect of refining the precipitate and thereby enhances the strength of the Al alloy. In the case of incorporating it for bringing out the effect above, this element is incorporated in an amount of 0.01% or more and needs not be contained in excess of 0.1%. For these reasons, the content of Ag when selectively incorporated is specified to the range from 0.1 to 0.01%.

(Si, Fe, Mn, Cr, Co, Ni, Zr, Ti, V)

Si, Fe, Mn, Cr, Co, Ni, Zr, Ti and V which are selective additive elements can enhance the strength of the Al alloy by a precipitation effect. In the case of incorporating such elements for bringing out this effect, one kind or two or more kinds selected from Si, Fe, Mn, Cr, Co, Ni, Zr, Ti and V are contained in an amount of 0.1% or more in total. However, if the total content of these elements exceeds 0.5%, a coarse precipitate of such an element is formed and this rather causes reduction of strength or ductility. For these reasons, in the case of selectively incorporating one kind or two or more kinds selected from these elements, the total content (total amount) is specified to the range from 0.1 to 0.5%.

(Oxygen)

In the present invention, the total amount of oxygen in the Al alloy obtained by solidifying a powder or preform resulting from rapid solidification by gas atomization, actually, oxygen present as an oxide inclusion in the microstructure, is reduced as specified above by the extraction residual method using hot phenol.

That is, the amount of oxygen contained in the Al alloy obtained by solidifying a powder or preform resulting from rapid solidification by gas atomization of a molten metal of the Al alloy comprising the above-described component composition, as measured by an extraction residue method using hot phenol, is set to 0.1 mass % or less in terms of oxygen in a solid residue which is separated and extracted from the Al alloy and has a size of 0.1 μm or more.

Due to this reduction, the oxide inclusion in the microstructure of the Al alloy can be reduced to such an extent that the inclusion cannot be recognized even by the observation of the microstructure with SEM or TEM. That is, the oxide inclusion in the Al alloy microstructure, which becomes an origin of fracture, can be decreased, as a result, the elongation can be greatly increased and the formability at cold working can be remarkably enhanced.

This effect appears as mechanical properties at an ordinary temperature of the Al alloy, namely, as specified in the present invention, the alloy has a tensile strength (high strength) of 600 MPa or more, and an elongation of 15% or more when the tensile strength is from 600 MPa or more and less than 800 MPa or an elongation of 10% or more when the tensile strength is 800 MPa or more. This elongation-enhancing effect is fairly revolutionary for the high-strength Al—Zn—Mg—Cu 7000-series Al alloy. The expression "the tensile strength is 800 MPa or more" as used in the present invention indicates more specifically that the upper limit is about 950 MPa and the tensile strength is in a high strength range from 800 to 950 MPa. Accordingly, the tensile strength of 600 MPa or more for an elongation of 15% or more is in a range from 600 MPa or more and less than 800 MPa.

Usually, the properties are enhanced according to the amount added in the case of an additive element or the amount reduced or the like in the case of an impurity element, but the way how the properties are enhanced generally shows only a proportional or inversely proportional linear relationship. Furthermore, as in Patent Document 1, usually, even a rapidly solidified powder of Al—Zn—Mg—Cu 7000-series Al alloy can hardly avoid great reduction of the elongation as the strength becomes higher. Therefore, the high-strength Al—Zn—Mg—Cu 7000-series Al alloy is, including Patent Document 1, used to have extremely poor cold workability as described above.

On the other hand, in the present invention, with respect to an Al—Zn—Mg—Cu 7000-series Al alloy, only by reducing the oxide inclusion in the Al alloy microstructure, the elongation when the tensile strength is 600 MPa can be increased to 15% or more from the conventional value of about 6%. Also, the elongation when the tensile strength is 800 MPa or more can be drastically increased to 10% or more from the conventional value of approximately from 2 to 3%. This indicates that severe cold working such as rolling, which has heretofore been unable to apply, can be performed. Accordingly, such an effect can be said to be revolutionary in terms of the rule of common sense in the above-described effect of reducing impurity elements or in the elongation of a rapidly solidified Al—Zn—Mg—Cu 7000-series Al alloy powder, which shows unavoidably great reduction as the strength becomes higher.

(Method for Reducing Oxygen)

The Al alloy of the present invention is produced by the later-described rapid solidification process, and it is important to reduce oxygen or not to increase oxygen at the rapid solidification of the molten metal. For reducing oxygen, whether a spray forming process or an atomized powder process (rapid solidified powder metallurgy process), air is not used for the atomizing gas but an inert atomizing gas such as nitrogen, Ar or He is used. Use of air for the atomizing gas is a major cause why in Patent Document 1, oxygen cannot be reduced unlike the present invention and the elongation cannot be increased.

(Method for Measuring Oxygen)

In the extraction residue method using hot phenol for use in the present invention, the alloy is treated with hot phenol, whereby the metal is separated as a liquid phase and the intermetallic compound precipitated in the microstructure is separated as a solid phase. This method is used as a general-purpose method for qualitatively or quantitatively determining the amount of the alloy element dissolved in the metal Al, the amount of the intermetallic compound precipitated, or the composition of the intermetallic compound.

In the present invention, the extraction residue method using hot phenol is utilized to dissolve an Al—Zn—Mg—Cu 7000-series Al alloy by using a hot phenol solution. At this time, Al as the metal matrix and Cu, Ag and the like dissolved in Al all are dissolved in the hot phenol solution. On the other hand, the intermetallic compound such as oxide inclusion precipitated in the microstructure does not dissolve but remains as a solid phase.

Here, when this hot phenol solution is filtered through a filter having a mesh size of 0.1 μm, the intermetallic compound such as oxide inclusion having a size of 0.1 μm or more remains as a solid residue on the filter. In this regard, an intermetallic compound such as an oxide inclusion having a size of less than 0.1 μm, if any, passes through the filter together with the hot phenol solution in which the above-described metal portion is dissolved. The minimum mesh size of the practical filter is 0.1 μm, and the oxide inclusion having a size of less than 0.1 μm is discounted in the present invention, because the absolute amount thereof is small or there is almost no effect on the elongation properties.

The total amount of oxygen in the solid residue (the Al-base intermetallic compound having a size of 0.1 μm or more) remaining on the filter is measured, and this total oxygen amount can be regarded as the total amount of oxygen in the oxide inclusion and the like. The measurement of the total oxygen amount in the solid residue remaining on the filter can be appropriately performed by ICP emission spectrometry or X-ray analysis. The measurement result of the total oxygen amount is used as the oxygen amount (mass %) in the solid residue and at the same time, used as the oxygen content contained in the 7000-series Al alloy.

(Impurities)

Other elements except for the elements described above are, like oxygen above, fundamentally unavoidable impurities and are allowed to be present to such a level as contained in the normal Al—Zn—Mg—Cu 7000-series Al alloy within the range not inhibiting the mechanical properties intended to attain in the present invention.

(Production Process)

The production process of the Al alloy of the present invention is described below. The Al—Zn—Mg—Cu 7000-series Al alloy of the present invention is produced not by a normal melting and casting process but produced by a rapid solidification process so as to precipitate a larger amount of the Zn- or Mg-based intermetallic compound and increase the strength. In this rapid solidification method, a powder or preform resulting from rapid solidification by gas atomization of a molten metal of the Al alloy is solidified. This solidification is densification, which is performed by forming the rapidly solidified powder or preform into various shapes by hot plastic working such as extrusion, forging and rolling. After the densification (solidification), a heat treatment such as solution treatment or aging treatment is applied.

(Rapid Solidification Process)

The rapid solidification process is by far higher in the cooling/solidification rate than the normal melting and casting process (ingot making), so that a fine intermetallic compound (the dispersed phase above) can be formed with high density. Also, due to the aging and precipitation hardening of this dispersed phase, the strength of the Al—Zn—Mg—Cu 7000-series Al alloy can be more enhanced. In addition, by virtue of rapidly solidifying the molten metal of the Al alloy, crystallization and segregation of the alloy element can be suppressed and a larger amount thereof can be dissolved in Al (the solid-solution range of the alloy element can be greatly expanded to the high concentration side). From this aspect, the strength of the Al alloy can be more enhanced.

In the rapid solidification process, as described above, it is important to reduce oxygen or not to increase oxygen. For reducing oxygen, whether a spray forming process or an atomized powder process (rapid solidified powder metallurgy process), as a premise, air is not used for the atomizing gas but an inert atomizing gas such as nitrogen, Ar or He is used. If air is used for the atomizing gas, although the strength is increased, oxygen cannot be reduced unlike the present invention and the elongation cannot be increased. In the case of using nitrogen as the atomizing gas, the nitrogen (N) is incorporated into the Al alloy in the course of atomization, so that the toughness of the Al alloy can be also enhanced in addition to high strength and high ductility. The nitrogen contained in the Al alloy is considered to be finely precipitated as AlN and in the step of producing the Al alloy such as deaeration, solution treatment and heat treatment for artificial aging, prevent the growth of a grain of the Al alloy, thereby ensuring a grain microstructure and enhancing the toughness of the Al alloy. The amount of nitrogen contained in the Al alloy varies depending on the atomization conditions such as the later-described gas/metal ratio (G/M ratio) of nitrogen.

(Atomized Powder Process)

In the case of producing the Al alloy of the present invention by an atomized powder process (rapid solidified powder metallurgy process) which is one of the rapid solidification processes, the atomized powder itself may be produced by a normal method. For example, an Al alloy having the composition of the present invention is melted at a temperature of 800 to 1,100° C. in a high-frequency induction melting furnace, and a molten metal of the Al alloy is poured in a crucible and then atomized by leading it from the opening at the bottom of the crucible to the molten metal discharge port of the atomizer nozzle.

Immediately before the molten metal of the Al alloy reaches the molten metal discharge port of the atomizer nozzle, an inert atomizing gas such as high-pressure nitrogen, Ar or He is blown from the nozzle hole, and the molten metal of the Al alloy discharged from the molten metal discharge port is finely pulverized by the pressure of the gas. The thus finely pulverized molten metal is immediately cooled with the high-pressure gas and/or atmosphere and solidified, whereby a rapidly solidified Al alloy powder is obtained.

The atomized Al alloy powder is sieved according to the usage. At this time, a fine powder having an average particle diameter of 150 μm or less, preferably 100 μm or less, is preferably classified and used. By solidifying and forming only such a fine particle powder by CIP or HIP, the Al alloy of the present invention can be easily obtained. If a coarse atomized powder having an average particle diameter exceeding 200 μm is used, the strength may not be enhanced, because the cooling rate is low and the amount of solute such as Cu and Ag is not ensured.

(Spray Forming Process)

In obtaining the alloy of the present invention, a spray forming process is more suitable than the above-described atomized powder process (rapid solidified powder metallurgy process). The spray forming process which is one of the rapid solidification processes has the same mechanism as the atomized powder process in that a gas is blown out and the molten metal is sprayed by the pressure of the gas. However, in the atomized powder process, even when an inert atomizing gas is used, handling of the powder must be performed in the atmosphere at the atomization, and oxygen in the Al alloy is likely to increase due to oxidation. On the other hand, in the spray forming process, even when the handling is performed in the atmosphere, a preform having a certain density has been already formed and is scarcely oxidized, and oxygen in the Al alloy is also hardly increased.

The spray forming process is advantageous over the atomized powder process also in that a preform having a certain density is obtained and preliminary solidification and forming by CIP or HIP is unnecessary. The atomized powder needs to be subjected to preliminary solidification and forming by CIP or HIP before being solidified. Furthermore, the spray forming process is advantageous in comparison with the atomized powder process in that a high cooling and solidification rate can be employed and in turn, a microstructure (intermetallic compound phase) can be refined.

Here, also in this spray forming process, the atomizing gas used is an inert atomizing gas such as high-pressure nitrogen, Ar or He, and an oxygen-containing atomizing gas such as air is not used, because oxygen in the Al alloy increases. Furthermore, the cooling and solidification rate needs to be optimized. In a preferred embodiment of the spray forming process, an Al alloy having the component composition of the present invention is melted at 800 to 1,100° C. and in this temperature range, spraying of the molten metal with an inert gas is started according to the spray forming process to produce a preform on a rotating bed lying in the lower part.

The cooling and solidification rate (during spraying) in the spray forming is controlled, for example, by a gas/metal ratio [G/M ratio; the ratio of the amount ($Nm^3$) of gas blown into the molten metal per unit mass (kg)]. In the present invention, as the G/M ratio is higher, the cooling rate can be higher, a finer intermetallic compound can be obtained, and a predetermined amount of Cu or Ag can be more successfully dissolved in the metal Al matrix.

If the G/M ratio is too low, the cooling and solidification rate is insufficient and in turn, the intermetallic compound by the alloy element becomes coarse, as a result, the alloy comes to lack the strength, whereas if the G/M ratio is excessively high, the yield (deposition efficiency of the molten metal) of the preform is reduced or the amount of the inert gas used is increased, giving rise to a high production cost.

The G/M ratio satisfying the conditions above is preferably from 2 to 15 $Nm^3$/kg. It is recommended that the lower limit of the G/M ratio is 2 $Nm^3$/kg or more, preferably 4 $Nm^3$/kg or more, more preferably 6 $Nm^3$/kg or more, and the upper limit of the G/M ratio is 15 $Nm^3$/kg or less, preferably 13 $Nm^3$/kg or less.

The Al alloy preform formed by the spray forming process under these conditions is obtained while keeping the porosity of about 10 vol %. Incidentally, the preform remaining in this state suffers from high porosity and insufficient toughness and therefore, the preform needs to be solidified for densification by deaerating the preform or dissolving the vacancies of the preform.

(Solidification, Densification)

As for the method of this solidification, the preform is preferably placed and vacuum-encapsulated in a vessel made of a metal such as Al and then solidified (densified) by hot extrusion working. In this regard, for preventing oxidation of the Al alloy and keeping a low oxygen state, the preform is preferably hot-worked by placing and vacuum-encapsulating it in a housing vessel made of a metal such as pure aluminum or appropriate aluminum alloy, without directly hot-working the preform.

In addition, the preform or powder obtained by the rapid solidified powder metallurgy process may be solidified (densified) by hot working including forging, rolling or an appropriate combination of extrusion, forging and rolling.

Before the hot working, the preform or powder obtained may be previously (preliminarily) densified, for example, by once hermetically sealing it in a vacuum vessel and applying a CIP or HIP treatment to effect solidification (crushing of vacancies or pores) and forming. However, in the HIP treatment and the like, the Al alloy (preform) is exposed to a high temperature for a long time and the intermetallic compound is likely to be coarsened. Therefore, as described above, the preform obtained by the spray forming process is preferably not subjected to a preliminary densification treatment such as HIP treatment.

The working temperature in the hot working of forging, extrusion or rolling is preferably set to a relatively low range of 425 to 500° C. When hot working is performed in such a working temperature range, the intermetallic compound including the Al-base intermetallic compound phase is not only refined but also uniformly dispersed. If the working temperature in the hot working is excessively high, the intermetallic compound is coarsened, whereas if the working temperature is too low, densification by hot working cannot be achieved.

For the same reasons, the working ratio in such hot working is set to be as large as possible. In the case of hot extrusion, the extrusion ratio is set to 6 or more, preferably 8 or more, more preferably 10 or more, and in the case of hot rolling or hot forging, the working ratio is set to 70% or more. If the extrusion ratio or working ratio is less than the range above, densification by hot working is highly likely to fail.

The solidified (densified) Al alloy after hot working is further subjected to a T6 treatment (heat treatment) of performing a solution treatment at approximately from 480 to 520° C. for 2 to 8 hours and an aging hardening treatment at approximately from 100 to 150° C. for 10 to 50 hours, to obtain a product of the Al—Zn—Mg—Cu 7000-series Al alloy (a material for components, members and the like) that is the Al alloy of the present invention.

The product of the Al alloy is worked by cold forming such as rolling into a desired member or component shape according to the usage such as automobile part, terminal machine for electronic materials and precision machinery component and used as a member or component in the usage.

The present invention is described in greater detail below by referring to Examples, but the present invention is not limited to these Examples and may be implemented by making appropriate changes or modifications within the range conformable to the purport indicated above or later, and these changes or modifications all are included in the technical scope of the present invention.

EXAMPLES

Example 1

A molten metal of an Al—Zn—Mg—Cu 7000-series Al alloy having the component composition shown in Table 1 was subjected to spray forming. At this time, as shown in Table 2, nitrogen ($N_2$) gas or air was used as the atomizing gas to control and change the amount of oxygen in the finally obtained Al alloy, whereby the effect of the amount of oxygen on the mechanical properties and cold workability of the Al alloy was evaluated.

More specifically, a molten metal of an Al alloy having each of the component compositions A to O shown in Table 1 below (A to J and N to O indicate compositions of Examples and K to M indicate compositions of Comparative Examples) was melted at a melting temperature of 1,000° C. in common among the alloys and spray-formed. The G/M ratio and the kind of atomizing gas used here are shown in Table 2.

The obtained preforms which were not subjected in common to a preliminary densification treatment such as HIP treatment each was placed and vacuum-encapsulated in an aluminum vessel and then solidified by directly applying hot extrusion working at a working temperature of 460° C. and an extrusion ratio of 15 to obtain a round bar thereof having 10 mmϕ. The obtained round bars of the Al alloy each was subjected in common to a T6 treatment (heat treatment) of performing a solution treatment at 500° C. for 5 hours and then performing an aging hardening treatment at 125° C. for 30 hours to obtain a product of the Al—Zn—Mg—Cu 7000-series Al alloy.

A specimen was sampled from each of these Al alloys, and not only the amount of oxygen contained in the Al alloy and the inclusion were examined but also the mechanical properties and cold workability were evaluated as follows. The results obtained are shown in Table 2.

(Amount of Oxygen)

The amount of oxygen contained in the specimen of the Al alloy was measured by the above-described extraction residue method using hot phenol to determine the amount of oxygen in a solid residue which is separated and extracted from the Al alloy and has a size of 0.1 μm or more.

(Inclusion)

At the same time, the oxide inclusion present in the microstructure of the specimen of the Al alloy was examined by the microstructure observation through TEM (transmission electron microscope) at a magnification of 15,000. The number of viewing fields to be measured was 20 portions extracted from arbitrary places of the round bar of the Al alloy. In the case where an oxide inclusion was not observed in any of these portions, the oxide inclusion was judged nil. In the case where an oxide inclusion was observed, the total number in 20 portions was counted as the number of oxide inclusions.

(Strength, Elongation)

In each of Examples, a specimen prepared by cutting the obtained round bar having 10 mmϕ was subjected to a room-temperature tensile test in the extrusion direction to measure the tensile strength (MPa) and the total elongation (%). The room-temperature tensile test was performed at room temperature of 20° C. based on JIS Z2241 (1980). The tensile speed was 5 mm/min, and the test was performed at a constant speed until the specimen was broken.

(Cold Workability)

In each of Examples, a specimen was prepared by cutting into 5 bars from the round bar having 10 mmϕ and worked by cold rolling into a cross-sectional T-shaped pin where a flange part was formed at one end of the specimen of the round bar. The specimen was rated "A" when rolling work could be performed in all of 5 times without generation of cracking; rated "C" when cracking was generated even once in the flange part or the like; and rated "B" when no cracking occurred but surface roughening or the like was generated.

TABLE 1

| Class | Alloy Code | Chemical Component Composition of Molten Metal of 7000-Series Al Alloy (mass %, remainder Al) Zn | Mg | Cu | Ag | Si, Fe, Mn, Cr, Co, Ni, Zr, Ti, V |
|---|---|---|---|---|---|---|
| Example | A | 9.5 | 3.0 | 1.5 | — | — |
| | B | 9.5 | 3.0 | 1.5 | 0.05 | — |
| | C | 5.0 | 3.0 | 1.5 | 0.05 | — |
| | D | 9.5 | 2.0 | 1.5 | 0.05 | — |
| | E | 9.5 | 3.0 | 1.0 | 0.05 | — |
| | F | 9.5 | 3.0 | 1.5 | — | Mn 0.1% |
| | G | 9.5 | 3.0 | 1.5 | 0.05 | Cr 0.1% |
| | H | 9.5 | 3.0 | 1.5 | — | Co 0.1%—Ni 0.1% |
| | I | 9.5 | 3.0 | 1.5 | 0.05 | Mn 0.1%—Zr 0.1%—Ti 0.1% |
| | J | 9.5 | 3.0 | 1.5 | — | Co 0.1%—Cr 0.1%—Ni 0.1%—Ti 0.1% |
| Comparative Example | K | 4.7 | 3.0 | 1.5 | — | — |
| | L | 9.5 | 1.6 | 1.5 | 0.05 | — |
| | M | 9.5 | 3.0 | 0.8 | 0.05 | — |
| Example | N | 9.5 | 3.0 | 1.5 | 0.05 | Si 0.1% |
| | O | 9.5 | 3.0 | 1.5 | — | Fe 0.1%—V 0.1% |

TABLE 2

| Class | No. | Alloy Code | Spray Forming: Gas Used | Average G/M Ratio ($Nm^3$/kg) | Al Alloy Microstructure: Content of Oxygen (mass %) | Number of Oxide Inclusions | Properties of Al Alloy: Tensile Strength (MPa) | Total Elongation (%) | Cold Workability |
|---|---|---|---|---|---|---|---|---|---|
| Example | 1 | A | nitrogen | 12 | 0.07 | nil | 765 | 19 | A |
| | 2 | A | nitrogen | 2 | 0.06 | nil | 695 | 21 | A |
| | 3 | B | nitrogen | 18 | 0.03 | nil | 830 | 17 | A |
| | 4 | B | nitrogen | 2 | 0.04 | nil | 721 | 19 | A |
| | 5 | C | nitrogen | 12 | 0.03 | nil | 754 | 20 | A |
| | 6 | D | nitrogen | 12 | 0.05 | nil | 783 | 15 | A |
| | 7 | E | nitrogen | 12 | 0.02 | nil | 799 | 16 | A |
| | 8 | F | nitrogen | 12 | 0.04 | nil | 840 | 11 | A |
| | 9 | G | nitrogen | 4 | 0.03 | nil | 820 | 14 | A |
| | 10 | H | nitrogen | 12 | 0.06 | nil | 832 | 12 | A |
| | 11 | I | nitrogen | 8 | 0.02 | nil | 893 | 11 | A |
| | 12 | J | nitrogen | 12 | 0.01 | nil | 901 | 11 | A |
| Comparative Example | 13 | A | air | 12 | 0.89 | 4 | 742 | 7 | C |
| | 14 | B | air | 12 | 0.95 | 6 | 791 | 4 | C |
| | 15 | J | air | 12 | 0.71 | 5 | 801 | 2 | C |
| | 16 | K | nitrogen | 12 | 0.05 | nil | 580 | 31 | A |
| | 17 | L | nitrogen | 12 | 0.02 | nil | 571 | 25 | A |
| | 18 | M | nitrogen | 12 | 0.02 | nil | 550 | 35 | A |
| Example | 19 | N | nitrogen | 10 | 0.02 | nil | 793 | 12 | A |
| | 20 | O | nitrogen | 10 | 0.02 | nil | 825 | 13 | A |

As apparent from Tables 1 and 2, in each of Examples 1 to 12, 19 and 20, spray forming with a nitrogen gas was performed using Al Alloys (molten metal) A to J and N to O having the composition of the present invention.

Due to the above, the amount of oxygen contained in the Al alloy as measured by an extraction residue method using hot phenol is 0.1 mass % or less and an oxide inclusion is not observed. Accordingly, the Al alloy has, as mechanical properties at an ordinary temperature, a tensile strength of 600 MPa or more, and an elongation of 15% or more when the tensile strength is 600 MPa or more and less than 800 MPa or an elongation of 10% or more when the tensile strength is 800 MPa or more. Thus, the cold workability is also excellent.

However, in Examples 2 and 4 where the G/M ratio at the spray forming is relatively small and is 2 $Nm^3$/kg that is the lower limit of the preferred condition, the tensile strength and the elongation are relatively low compared with Examples 1 and 3 having a relatively large G/M ratio and differing only in the G/M ratio.

On the other hand, in Comparative Examples 13, 14 and 15, A, B and J in Table 1 are used as the composition in the composition range of the present invention and the G/M ratio thereof is also in the preferred range, but the spray forming is performed using air.

As a result, in Comparative Examples 13, 14 and 15, the amount of oxygen contained in the Al alloy is high and exceeds 0.1 mass % as measured by the extraction residue method using hot phenol and a substantial amount of an oxide inclusion is observed. Accordingly, the elongation when the tensile strength is 600 MPa or more and the elongation when the tensile strength is 800 MPa or more are extremely low. That is, in Comparative Examples 13, 14 and 15, similarly to conventional ones, the elongation is conspicuously low and the cold workability is seriously poor, despite high strength.

In Comparative Example 16, Alloy K in Table 1 where the content of Zn falls below the lower limit is used, in Comparative Example 17, Alloy L in Table 1 where the content of Mg falls below the lower limit is used, and in Comparative Example 18, Alloy M in Table 1 where the content of Cu falls below the lower limit is used.

Accordingly, in Comparative Examples 16 to 18, despite the production by a preferred production process, the tensile strength is low and is less than 600 MPa. As a result, although not only the amount of oxygen contained in the Al alloy as measured by the extraction residue method using hot phenol is 0.1 mass % or less and an oxide inclusion is not observed but also the elongation or rating of cold workability is high, the high strength required in the usage is not satisfied.

These results support the critical meaning of each of the requirements or preferred requirements of the present invention for satisfying high strength and high ductility of an Al—Zn—Mg—Cu 7000-series Al alloy.

Example 2

The amount of nitrogen (N) incorporated into the Al alloy and the effect of enhancing the toughness of the Al alloy when using nitrogen for the atomizing gas were examined. A molten metal of a Al—Zn—Mg—Cu 7000-series Al alloy having the composition of Alloy Code B in Table 1 was used and all of them were used as Examples, and as shown in Table 3, spray forming was performed using nitrogen ($N_2$) gas as the atomizing gas under the condition of the G/M ratio being in the preferred range. Also, for comparison and reference but still as Example, spray forming was performed using argon (Ar) gas as the atomizing gas under the condition of the G/M ratio being in the preferred range.

From the preform produced in each of Examples above, a round bar thereof having 10 mmϕ which was subjected in common to a T6 treatment was obtained under the same production conditions as in Example 1. A specimen was sampled from the Al alloy, and the room-temperature toughness of the Al alloy was examined and evaluated by a general-purpose Charpy impact test. Also, the amount of oxygen contained in the Al alloy and the inclusion were examined in the same manner as in Example 1 and the amount of nitrogen contained in the Al alloy was examined as well. Furthermore, the mechanical properties and the cold workability were evaluated. The results obtained are shown in Table 3.

TABLE 3

| | | Spray Forming | | Microstructure of Al Alloy | | | Properties of Al Alloy | | | |
|---|---|---|---|---|---|---|---|---|---|---|
| No. | Alloy Code | Gas Used | Average G/M Ratio ($Nm^3$/kg) | Content of Oxygen (mass %) | Number of Oxide Inclusions | Content of Nitrogen (mass %) | Tensile Strength (MPa) | Total Elongation (%) | Cold Workability | Toughness ($kJ/m^2$) |
| 21 | B | nitrogen | 5 | 0.02 | nil | 0.009 | 785 | 14 | A | 221 |
| 22 | B | nitrogen | 12 | 0.03 | nil | 0.006 | 792 | 18 | A | 302 |
| 23 | B | nitrogen | 15 | 0.03 | nil | 0.0002 | 801 | 23 | A | 121 |
| 24 | B | nitrogen | 3 | 0.02 | nil | 0.02 | 770 | 13 | A | 83 |
| 25 | B | Ar | 4 | 0.02 | nil | 0.0001 | 778 | 16 | A | 75 |
| 26 | B | Ar | 12 | 0.01 | nil | 0.0001 | 805 | 19 | A | 82 |

As seen from Table 3, in Examples 21 to 24 using nitrogen as the atomizing gas, the content of nitrogen is naturally high compared with that in Examples 25 and 26 using argon as the atomizing gas. Of these, in Examples 21 to 23, the G/M ratio at the spray forming is more appropriate and therefore, the toughness of the Al alloy is high compared with that in Examples 25 and 26. Accordingly, the contribution of the contained nitrogen to the enhancement of toughness of the Al alloy and the meanings of nitrogen gas atomization and atomization conditions are confirmed. Incidentally, referring to the data in Table 3, the amount of nitrogen contained in the Al alloy is approximately from 0.0002 to 0.01 mass % in terms of the range of the preferred gas/metal ratio (G/M ratio).

INDUSTRIAL APPLICABILITY

As described above, the present invention can provide a high-strength and high-ductility Al alloy that is an Al—Zn—Mg—Cu 7000-series Al alloy obtained by solidifying a rapidly solidified powder or preform, and a process for production of the same. This is worked by cold forming into a desired shape according to the usage by taking advantage of its high ductility and used as desired members or components by taking advantage of its high strength and is suitable as an automobile part, a terminal machine for electronic materials, a precision machinery component and the like.

While the invention has been described in detail and with reference to specific embodiments thereof, it will be apparent to one skilled in the art that various changes and modifications can be made therein without departing from the spirit and scope thereof. This application is based on Japanese Patent Application No. 2007-049891 filed on Feb. 28, 2007 and Japanese Patent Application No. 2007-199598 filed on Jul. 31, 2007, and their contents are incorporated herein by way of reference.

The invention claimed is:

1. A high-strength and high-ductility Al alloy, which is obtained by a rapid solidification process comprising:

(a) subjecting a molten metal, comprising:

Al;

from 5 to 12 mass % of Zn;

from 2 to 4 mass % of Mg; and from 1 to 2 mass % of Cu;

at least one of: from 0.01 to 0.1 mass % of Ag and from 0.1 to 0.5 mass % in total of at least one selected from the group consisting of Si, Fe, Mn, Cr, Co, Ni, Zr, Ti and V; and an unavoidable impurity, to spray forming with an inert gas having a gas/metal ratio of 6 to 15 $Nm^3$/kg, such that a cooling and solidification rate is controlled by the gas/metal ratio of the inert gas blown into the molten metal, to form a preform;

(b) placing and vacuum-encapsulating the preform in a metal vessel;

(c) solidifying the preform by hot extrusion; and then (d) applying a heat treatment thereto to obtain an Al alloy, wherein:

an amount of oxygen contained in the Al alloy as measured by an extraction residue method using hot phenol is 0.1 mass % or less in terms of oxygen in a solid residue which is separated and extracted from the Al alloy and has a size of 0.1 μm or more; and the Al alloy has a tensile strength of 600 MPa or more, and (i) an elongation of 15% or more when the tensile strength is 600 MPa or more and less than 800 MPa, or (ii) an elongation of 10% or more when the tensile strength is 800 MPa or more.

2. The Al alloy according to claim 1, comprising from 0.01 to 0.1 mass % of Ag.

3. The Al alloy according to claim 2, further comprising from 0.1 to 0.5 mass % in total of at least one member selected from the group consisting of Si, Fe, Mn, Cr, Co, Ni, Zr, Ti and V.

4. The Al alloy according to claim 1, comprising from 0.1 to 0.5 mass % in total of at least one member selected from the group consisting of Si, Fe, Mn, Cr, Co, Ni, Zr, Ti and V.

5. The Al alloy according to claim 1, wherein an oxide inclusion in the Al alloy is not observed under SEM or TEM.

6. The Al alloy according to claim 1, wherein the rapid solidification process comprises blowing a nitrogen gas to the molten metal of the Al alloy.

7. The Al alloy according to claim 1, wherein the molten metal consists of:

Al;

from 5 to 12 mass % of Zn;

from 2 to 4 mass % of Mg; and from 1 to 2 mass % of Cu;

at least one of: from 0.01 to 0.1 mass % of Ag and from 0.1 to 0.5 mass % in total of at least one selected from the group consisting of Si, Fe, Mn, Cr, Co, Ni, Zr, Ti and V; and an unavoidable impurity.

8. The Al alloy according to claim 1, wherein the preform formed by the spray forming (a) has a porosity of equal to or less than 10 vol %.

9. The Al alloy according to claim 1, wherein the working temperature during the extrusion (c) is from 425 to 500° C.

10. The Al alloy according to claim 1, wherein an extrusion ratio for the extrusion (c) is 6 or more.

11. A process for producing a high-strength and high-ductility Al alloy, the process comprising:

(a) subjecting a molten metal of an Al alloy, comprising:

Al;

from 5 to 12 mass % of Zn;

from 2 to 4 mass % of Mg;

from 1 to 2 mass % of Cu;

at least one of: from 0.01 to 0.1 mass % of Ag and from 0.1 to 0.5 mass % in total of at least one selected from the group consisting of Si, Fe, Mn, Cr, Co, Ni, Zr, Ti and V; and an unavoidable impurity, to spray forming with an inert gas having a gas/metal ratio of 6 to 15 $Nm^3/kg$, to form a preform;

(b) placing and vacuum-encapsulating the preform in a metal vessel;

(c) solidifying the preform by hot extrusion; and then (d) applying a heat treatment thereto to obtain an Al alloy, wherein:

an amount of oxygen contained in the Al alloy as measured by an extraction residue method using hot phenol is set to 0.1 mass % or less in terms of oxygen in a solid residue which is separated and extracted from the Al alloy and has a size of 0.1 μm or more; and the Al alloy has, as mechanical properties at an ordinary temperature, a tensile strength of 600 MPa or more, and (i) an elongation of 15% or more when the tensile strength is from 600 MPa or more and less than 800 MPa, or (ii) an elongation of 10% or more when the tensile strength is 800 MPa or more.

* * * * *